US006017091A

United States Patent [19]

Cao

[11] Patent Number: 6,017,091

[45] Date of Patent: Jan. 25, 2000

[54] ADJUSTABLE ARMREST ASSEMBLY

[76] Inventor: Zi-Wen Cao, 9F, No. 145, Ta-An Rd., Ta-An Sec, Taipei, Taiwan

[21] Appl. No.: 09/261,983

[22] Filed: Mar. 4, 1999

[51] Int. Cl.[7] ..... A47C 7/54

[52] U.S. Cl. ..... 297/411.37; 297/411.35

[58] Field of Search ..... 297/411.2, 411.26, 297/411.35, 411.37, 411.38; 248/118

[56] References Cited

U.S. PATENT DOCUMENTS 5,415,459 5/1995 Schultz .
5,484,187 1/1996 Doerner et al. .
5,590,934 1/1997 Gibbs .
5,641,203 6/1997 Van De Riet et al. .
5,651,586 7/1997 Groth .
5,655,814 8/1997 Gibbs .
5,884,976 3/1999 Breen et al. .

*Primary Examiner*—Milton Nelson, Jr.
*Attorney, Agent, or Firm*—Alan Kamrath; Oppenheimer, Wolff & Donnelly, LLP

[57] ABSTRACT

An adjustable armrest assembly has a fixed seat, a control seat disposed on the fixed seat, a pad seat disposed on the control seat, a main body disposed on the pad seat, and a cover plate covering the main body. The fixed seat has two through apertures. The control seat has two stepped holes, two threaded apertures, and two upper grooves. The main body has a lower recess receiving the pad seat and the control seat, an upper recess receiving an elastic plate, and a separation plate. Two slide seats are inserted in the stepped holes. Two hollow cylinders are inserted in the upper grooves.

1 Claim, 6 Drawing Sheets

ADJUSTABLE ARMREST ASSEMBLY

BACKGROUND OF THE INVENTION

The present invention relates to an adjustable armrest assembly. More particularly, the present invention relates to an adjustable armrest assembly for a chair or for a sofa.

Referring to FIGS. 4 to 6, an adjustable armrest device comprises a fixed seat 4, a main body 1 covering an upper portion of the fixed seat 4, and an insert block 2 disposed between the main body 1 and the fixed seat 4. The fixed seat 4 comprises a first through aperture 41 and a second through aperture 41'. The insert block 2 comprises a first stepped hole 22, a second stepped hole 22', a first threaded aperture 21, a second threaded aperture 21', a first upper groove 20, and a second upper groove 20'. The main body 1 comprises a lower recess 11 receiving the insert block 2, a first threaded hole 12, a second threaded hole 12', a circular recess hole 13, a circular blind hole 13', two round recess holes 14, and two round blind holes 14'. A first slide seat 3 is inserted in the first stepped hole 22. The first slide seat 3 has a first through hole 31 receiving a first threaded fastener 32. A second slide seat 3' is inserted in the second stepped hole 22'. The second slide seat 3' has a second through hole 31' receiving a second threaded fastener 32'. A first hollow cylinder 25 is inserted in the first upper groove 20. A first elastic spring 24 and a first ball 23 are inserted in the first hollow cylinder 25. A second hollow cylinder 25' is inserted in the second upper groove 20'. A second elastic spring 24' and a second ball 23' are inserted in the second hollow cylinder 25'. The first threaded fastener 32 is inserted through the first through hole 31 of the first slide seat 3 and inserted in the first threaded hole 12 of the main body 1. The second threaded fastener 32' is inserted through the second through hole 31' of the second slide seat 3' and inserted in the second threaded hole 12' of the main body 1. A first bolt 42 passes through the first through aperture 41 and the first threaded aperture 21 to fasten the fixed seat 4 and the insert block 2 together. A second bolt 42' passes through the second through aperture 41' and the second threaded aperture 21' to fasten the fixed seat 4 and the insert block 2 together. The first ball 23 is inserted in the circular recess hole 13 of the main body 1. The second ball 23' is inserted in the circular blind hole 13' of the main body 1. The fixed seat 4 is disposed on a chair. The first through hole 31 of the first slide seat 3 has a step shape. The second through hole 31' of the second slide seat 3' has a step shape. Referring to FIG. 6, the main body 1 can be pushed toward the chair or out of the chair. The first ball 23 will be departed from the circular recess hole 13 and inserted in one of the round recess holes 14. The second ball 23' will be departed from the circular blind hole 13' and inserted in one of the round blind holes 14'. Thus the first ball 23 and the second ball 23' will move in the same direction. Referring to FIG. 5, one end of the main body 1 can be pushed toward the chair and the other end of the main body 1 can be pushed out of the chair. The first ball 23 and the second ball 23' will move in the opposite directions. However, the length of the main body 1 is not long enough to receive the whole forearm of the user.

SUMMARY OF THE INVENTION

An object of the present invention is to provide an adjustable armrest assembly which can be adjusted easily.

Another object of the present invention is to provide an adjustable armrest assembly which has a cover plate covering a main body so that the whole forearm of the user can lie on the cover plate comfortably.

Accordingly, an adjustable armrest assembly comprises a fixed seat, a control seat disposed on the fixed seat, a pad seat disposed on the control seat, a main body disposed on the pad seat, and a cover plate covering the main body. The fixed seat comprises a first through aperture and a second through aperture. The control seat comprises a first stepped hole, a second stepped hole, a first threaded aperture, a second threaded aperture, a first upper groove, and a second upper groove. The pad seat has a first oblong hole, a second oblong hole, a plurality of first lower blind holes, and a plurality of second lower blind holes. The main body comprises a lower recess receiving the pad seat and the control seat, an upper recess receiving an elastic plate, and a separation plate separating the lower recess and the upper recess. The separation plate has a first slot and a second slot. The elastic plate has a first end, a second end, a first through hole, and a second through hole. A first hollow slide seat is inserted in the first stepped hole. The first hollow slide seat receives a first threaded fastener. A second hollow slide seat is inserted in the second stepped hole. The second hollow slide seat receives a second threaded fastener. A first hollow cylinder is inserted in the first upper groove. A first elastic spring and a first ball are inserted in the first hollow cylinder. A second hollow cylinder is inserted in the second upper groove. A second elastic spring and a second ball are inserted in the second hollow cylinder. The first threaded fastener is inserted through the first hollow slide seat, the first slot, and the first through hole. The second threaded fastener is inserted through the second hollow slide seat, the second slot, and the second through hole. A first nut engages with the first threaded fastener. A second nut engages with the second threaded fastener. A first bolt passes through the first through aperture and the first threaded aperture to fasten the fixed seat and the control seat together. A second bolt passes through the second through aperture and the second threaded aperture to fasten the fixed seat and the control seat together. The first ball is inserted in one of the first lower blind holes. The second ball is inserted in one of the second lower blind holes.

DETAILED DESCRIPTION OF THE INVENTION

Figure 1:
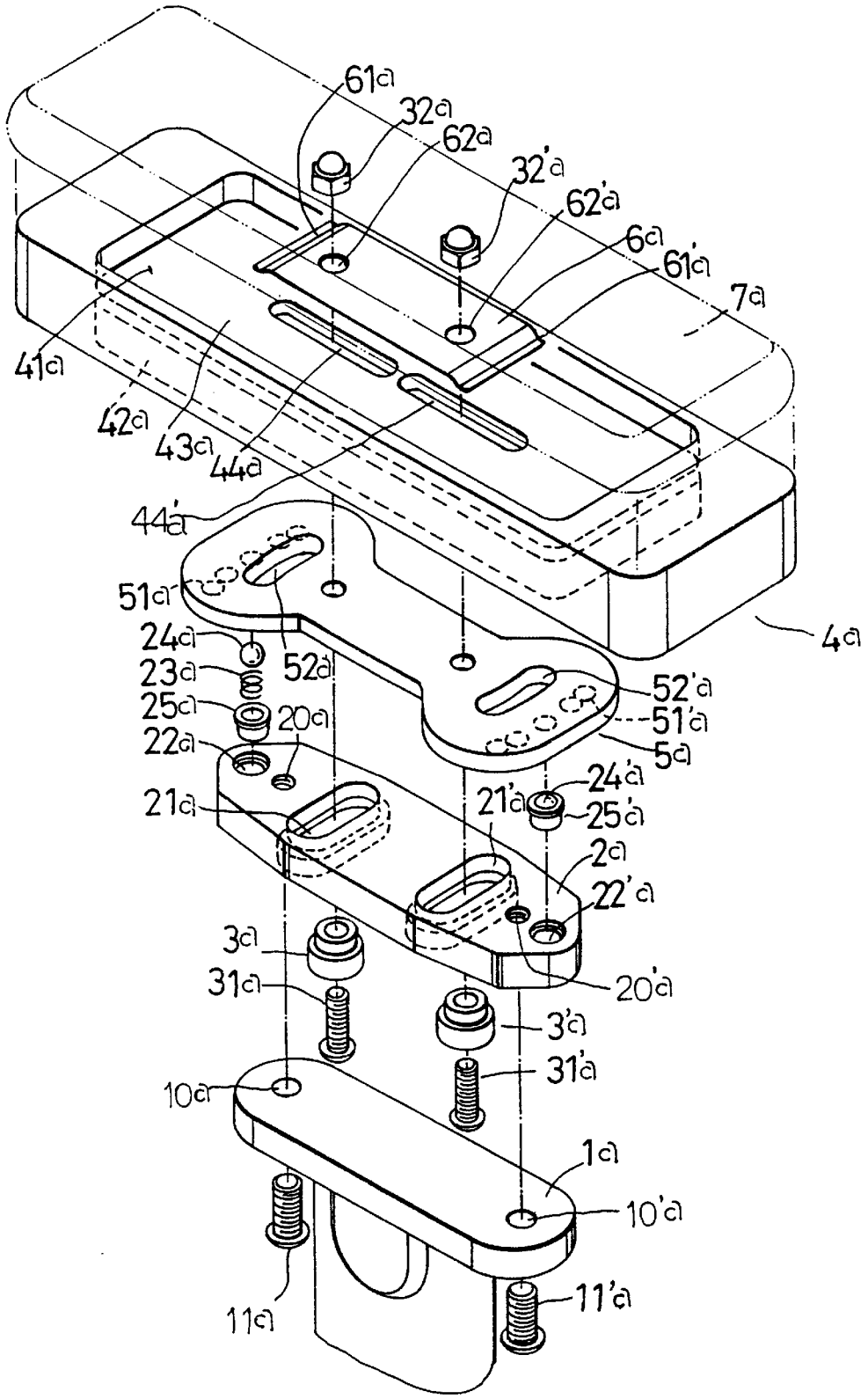
FIG. 1 is a perspective exploded view of an adjustable armrest assembly of a preferred embodiment in accordance with the present invention.
Figure 2:
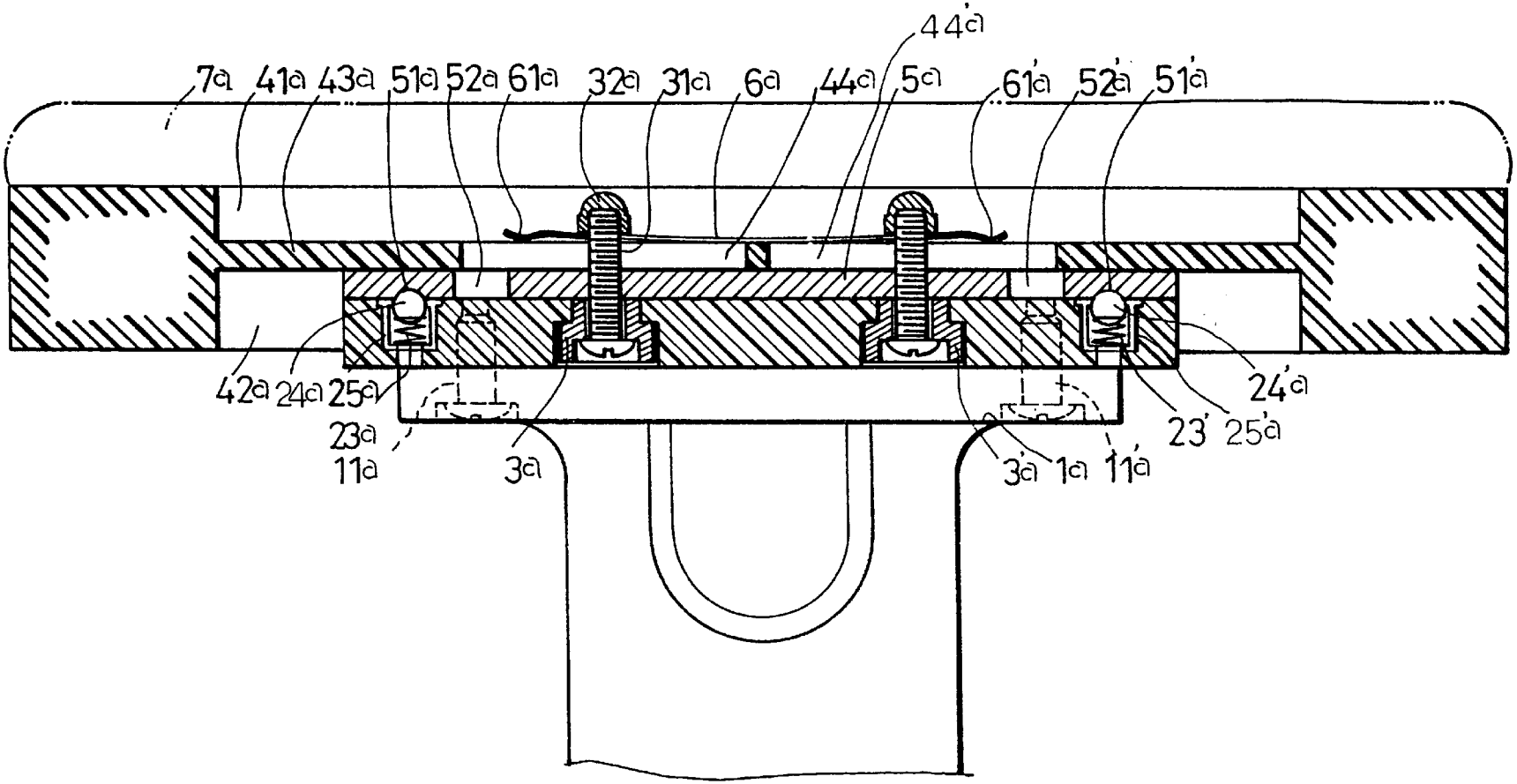
FIG. 2 is a sectional assembly view of an adjustable armrest assembly of a preferred embodiment in accordance with the present invention.
Figure 3:
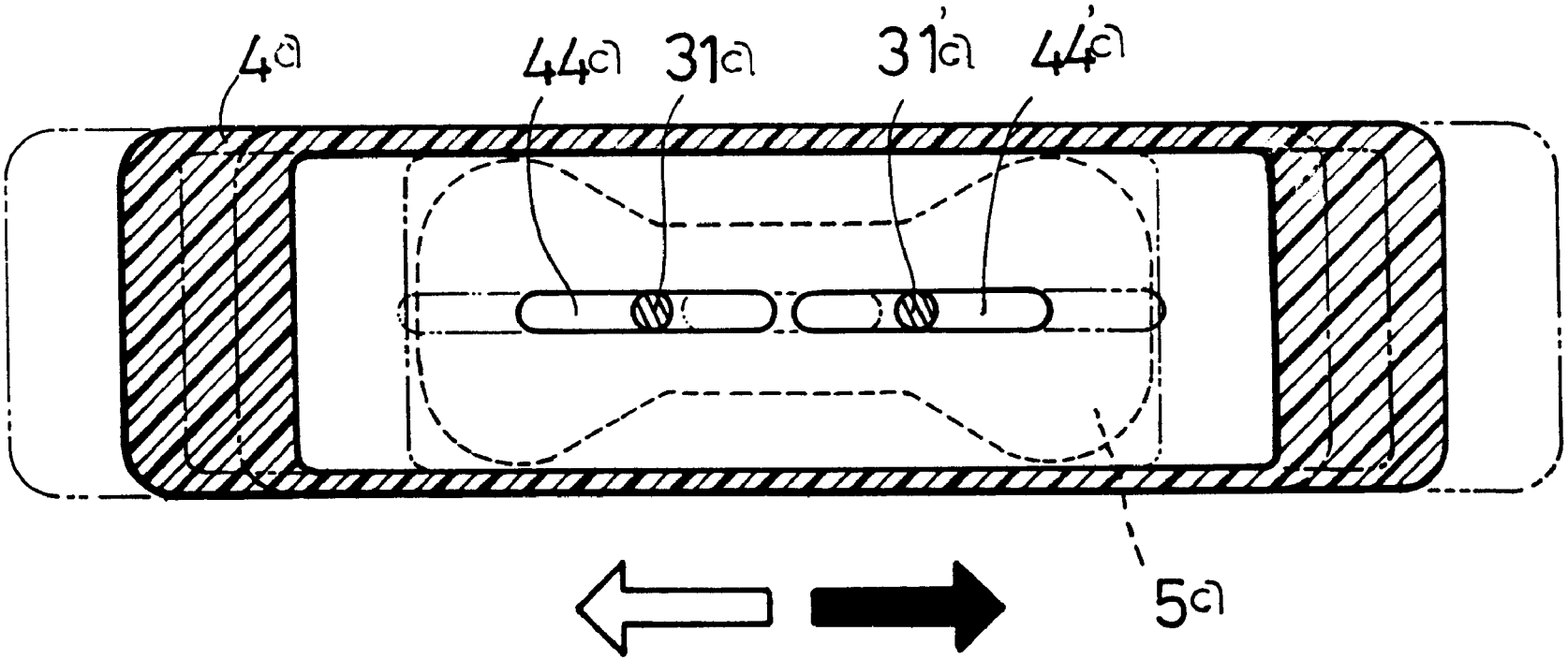
FIG. 3 is a sectional schematic view illustrating an operation of an adjustable armrest assembly of a preferred embodiment in accordance with the present invention.
Figure 4:
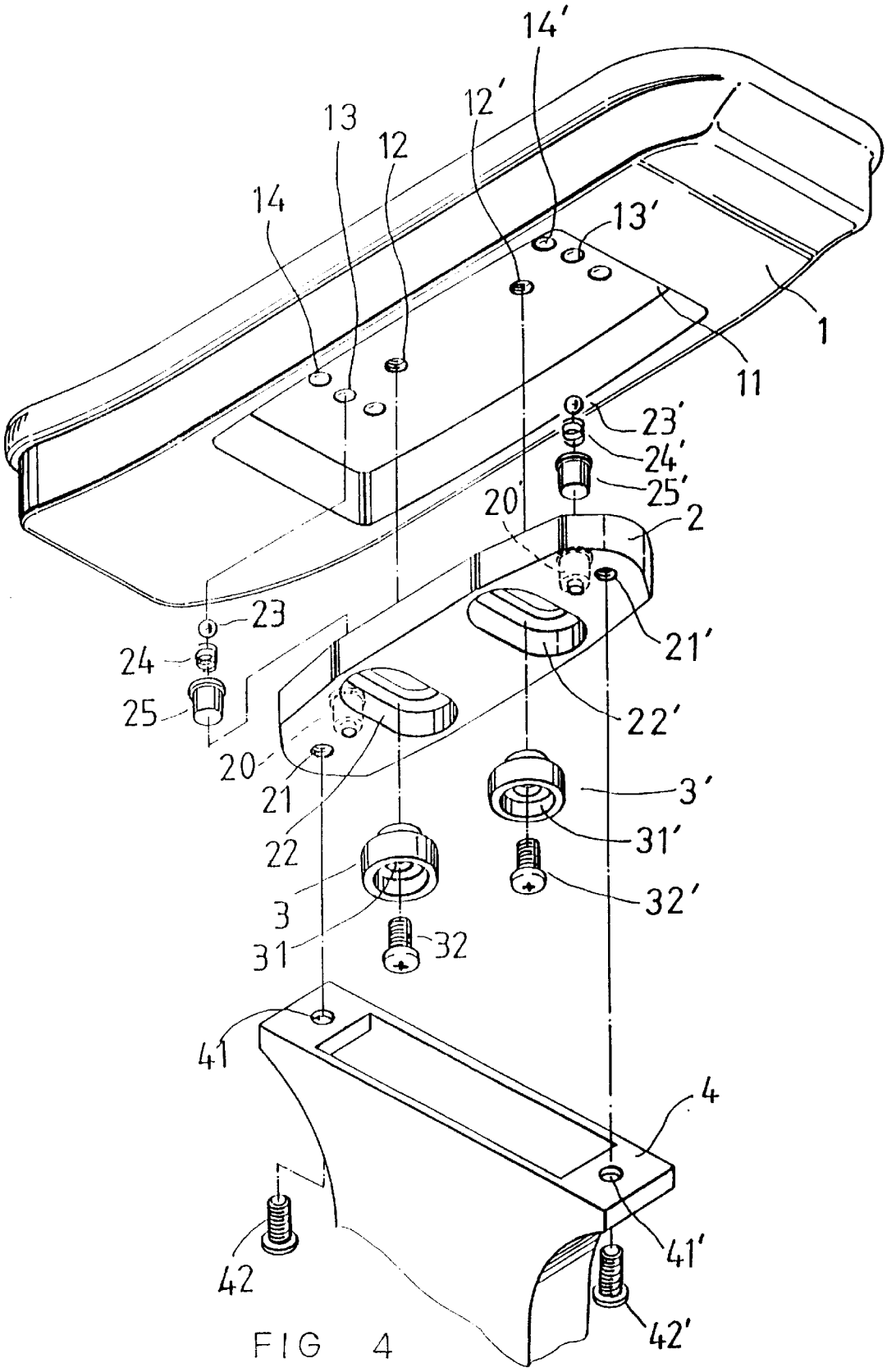
FIG 4 PRIOR ART
FIG. 4 is a perspective exploded view of an adjustable armrest device of the prior art.
Figure 5:
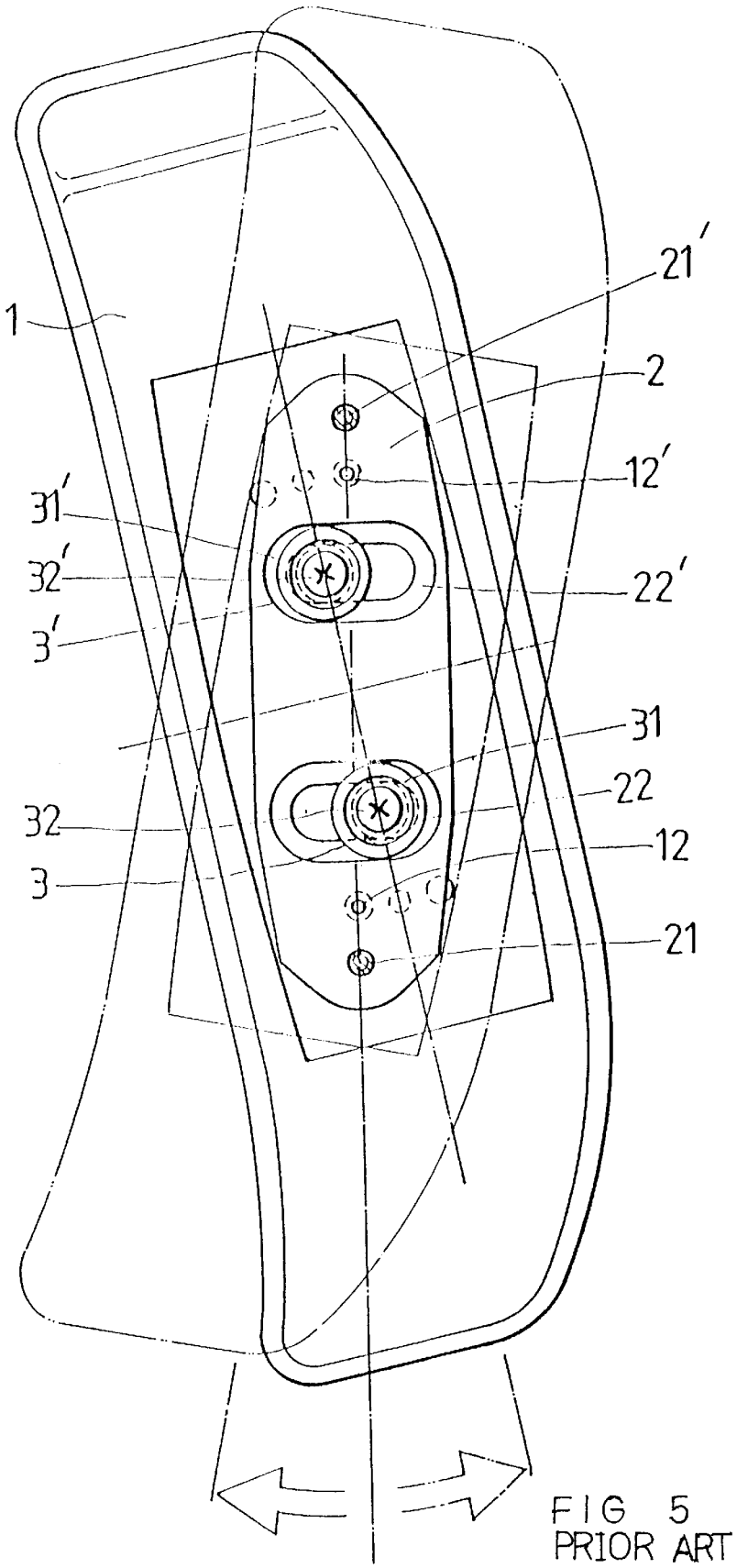
FIG 5 PRIOR ART
FIG. 5 is a schematic view illustrating an operation of an adjustable armrest device of the prior art.
Figure 6:
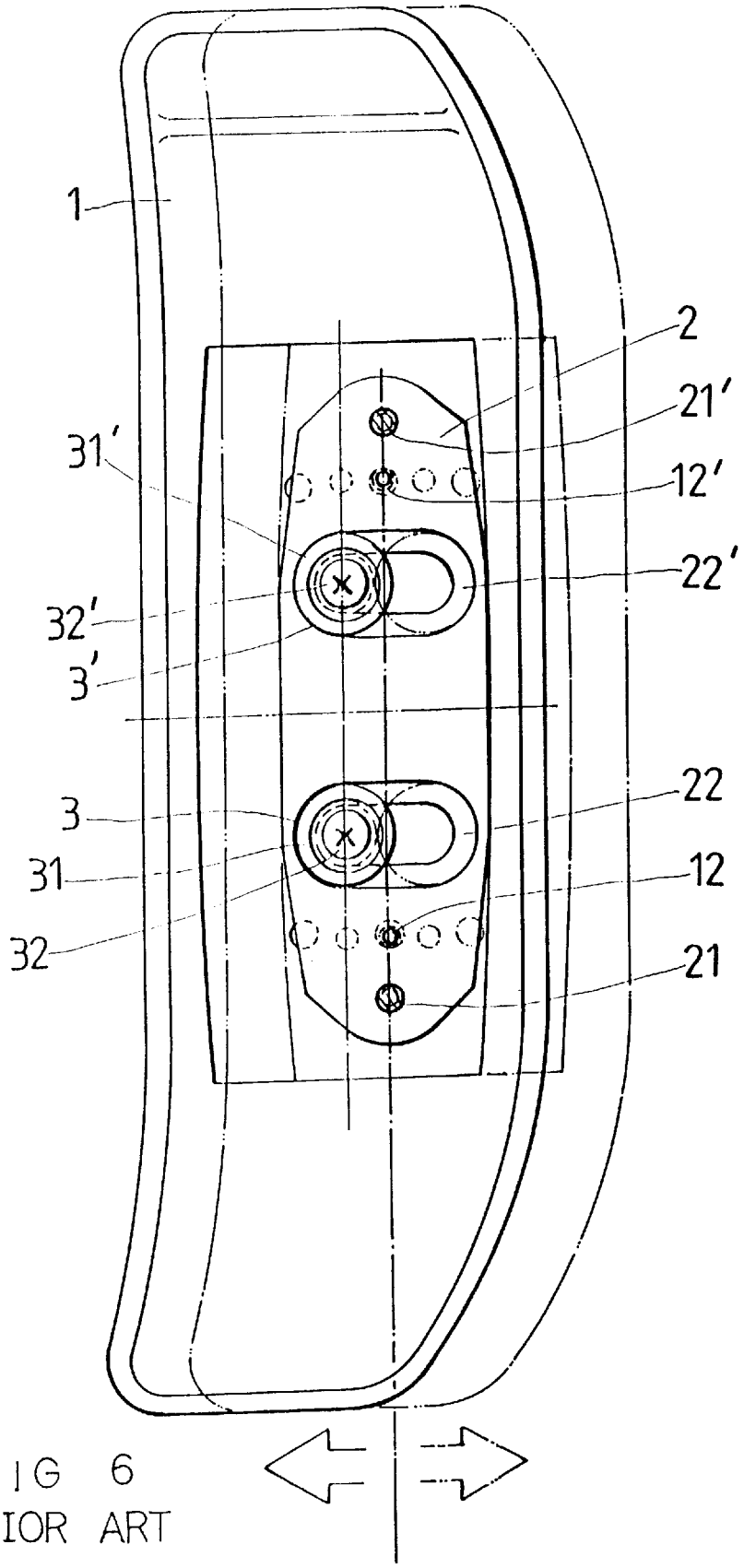
FIG 6 PRIOR ART
FIG. 6 is a schematic view illustrating another operation of an adjustable armrest device of the prior art.

Referring to FIGS. 1 to 3, an adjustable armrest assembly comprises a fixed seat 1*a*, a control seat 2*a* disposed on the fixed seat 1*a*, a pad seat 5*a* disposed on the control seat 2*a*, a main body 4*a* disposed on the pad seat 5*a*, and a cover plate 7*a* covering the main body 4*a*.

The fixed seat la comprises a first through aperture 10*a* and a second through aperture 10'*a*.

The control seat 2*a* comprises a first stepped hole 21*a*, a second stepped hole 21'*a*, a first threaded aperture 20*a*, a second threaded aperture 20'*a*, a first upper groove 22*a*, and a second upper groove 22'*a*.

The pad seat 5*a* has a first oblong hole 52*a*, a second oblong hole 52'*a*, a plurality of first lower blind holes 51*a*, and a plurality of second lower blind holes 51'*a*.

The main body 4*a* comprises a lower recess 42*a* receiving the pad seat 5*a* and the control seat 2*a*, an upper recess 41*a* receiving an elastic plate 6*a*, and a separation plate 43*a* separating the lower recess 42*a* and the upper recess 41*a*.

The separation plate 43*a* has a first slot 44*a* and a second slot 44'*a*.

The elastic plate 6*a* has a first end 61*a*, a second end 61'*a*, a first through hole 62*a*, and a second through hole 62'*a*.

A first hollow slide seat 3*a* is inserted in the first stepped hole 21*a*. The first hollow slide seat 3*a* receives a first threaded fastener 31*a*. A second hollow slide seat 3'*a* is inserted in the second stepped hole 21'*a*. The second hollow slide seat 3'*a* receives a second threaded fastener 31'*a*. A first hollow cylinder 25*a* is inserted in the first upper groove 22*a*. A first elastic spring 23*a* and a first ball 24*a* are inserted in the first hollow cylinder 25*a*. A second hollow cylinder 25'*a* is inserted in the second upper groove 22'*a*. A second elastic spring 23'*a* and a second ball 24'*a* are inserted in the second hollow cylinder 25'*a*. The first threaded fastener 31*a* is inserted through the first hollow slide seat 3*a*, the first slot 44*a*, and the first through hole 62*a*. The second threaded fastener 31'*a* is inserted through the second hollow slide seat 3'*a*, the second slot 44'*a*, and the second through hole 62'*a*. A first nut 32*a* engages with the first threaded fastener 31*a*. A second nut 32'*a* engages with the second threaded fastener 31'*a*. A first bolt 11*a* passes through the first through aperture 10*a* and the first threaded aperture 20*a* to fasten the fixed seat 1*a* and the control seat 2*a* together. A second bolt 11'*a* passes through the second through aperture 10'*a* and the second threaded aperture 20'*a* to fasten the fixed seat 1*a* and the control seat 2*a* together. The first ball 24*a* is inserted in one of the first lower blind holes 51*a*. The second ball 24'*a* is inserted in one of the second lower blind holes 51'*a*. The fixed seat 4 is disposed on a chair (not shown in the figures).

Referring to FIGS. 1 to 3 again, the cover plate 7*a* is operated by the user. When the cover plate 7*a* is moved, the cover plate 7*a* drives the main body 4*a* to move also. When the force of the hand is larger than the pressing force of the elastic plate 6*a*, the cover plate 7*a* can be moved forward or rearward. The main body 4*a* can be pushed toward the chair or out of the chair. The first ball 24*a* will be inserted in one of the first lower blind holes 51*a*. The second ball 24'*a* will be inserted in one of the second lower blind holes 51'*a*. Thus the first ball 24*a* and the second ball 24'*a* will move in the same direction.

Therefore, the adjustable armrest assembly of the present invention can be adjusted easily.

The present invention is not limited to the above embodiment but various modification thereof may be made. Furthermore, various changes in form and detail may be made without departing from the scope of the present invention.

I claim:

1. An adjustable armrest assembly comprises:

a fixed seat, a control seat disposed on the fixed seat, a pad seat disposed on the control seat, a main body disposed on the pad seat, a cover plate covering the main body, the fixed seat comprising a first through aperture and a second through aperture, the control seat comprising a first stepped hole, a second stepped hole, a first threaded aperture, a second threaded aperture, a first upper groove, and a second upper groove, the pad seat having a first oblong hole, a second oblong hole, a plurality of first lower blind holes, and a plurality of second lower blind holes, the main body comprising a lower recess receiving the pad seat and the control seat, an upper recess receiving an elastic plate, and a separation plate separating the lower recess and the upper recess, the separation plate having a first slot and a second slot, the elastic plate having a first end, a second end, a first through hole, and a second through hole, a first hollow slide seat inserted in the first stepped hole, the first hollow slide seat receiving a first threaded fastener, a second hollow slide seat inserted in the second stepped hole, the second hollow slide seat receiving a second threaded fastener, a first hollow cylinder inserted in the first upper groove, a first elastic spring and a first ball inserted in the first hollow cylinder, a second hollow cylinder inserted in the second upper groove, a second elastic spring and a second ball inserted in the second hollow cylinder, the first threaded fastener inserted through the first hollow slide seat, the first slot, and the first through hole, the second threaded fastener inserted through the second hollow slide seat, the second slot, and the second through hole, a first bolt passing through the first through aperture and the first threaded aperture to fasten the fixed seat and the control seat together, a second bolt passing through the second through aperture and the second threaded aperture to fasten the fixed seat and the control seat together, the first ball inserted in one of the first lower blind holes, and the second ball inserted in one of the second lower blind holes.

* * * * *